US010618316B1

(12) United States Patent
Shiue

(10) Patent No.: US 10,618,316 B1
(45) Date of Patent: Apr. 14, 2020

(54) METHOD FOR DIGITALLY PRINTING PATTERNS ON HIGH-ELASTICITY WETSUITS

(71) Applicant: Jeff Heng-Wen Shiue, Wujie (TW)

(72) Inventor: Jeff Heng-Wen Shiue, Wujie (TW)

(73) Assignee: SHEI CHUNG HSIN IND. CO., LTD., Wujei (TW)

( * ) Notice: Subject to any disclaimer, the term of this patent is extended or adjusted under 35 U.S.C. 154(b) by 0 days.

(21) Appl. No.: 16/219,891

(22) Filed: Dec. 13, 2018

(51) Int. Cl.
*B41J 3/407* (2006.01)
*D06P 5/30* (2006.01)
*B63C 11/04* (2006.01)

(52) U.S. Cl.
CPC ..... *B41J 3/4078* (2013.01); *B63C 11/04* (2013.01); *D06P 5/30* (2013.01); *B63C 2011/046* (2013.01)

(58) Field of Classification Search
CPC ..... B41J 3/4078; D06P 5/30; B63C 11/04; B63C 2011/046
See application file for complete search history.

(56) References Cited

FOREIGN PATENT DOCUMENTS

CN 106351038 A * 1/2017 ..... D06P 1/50

OTHER PUBLICATIONS

Google translation of CN106351038A, published on Jan. 2017 (Year: 2017).*
https://www.printheadstudio.com/?gclid=EAIaIQobChMlw_fV4arO5A1VGozlCh0gPA2JEAMYAyAAEgK55vD_BwE.*

* cited by examiner

*Primary Examiner* — Huan H Tran

(57) ABSTRACT

A method comprises: coating a high-elasticity coating on a rubber foam or high-elasticity fabric of a wetsuit to form a substrate to be printed; providing a digital printing machine for uploading an image file of a pattern or logo to the digital printing machine; and providing a vacuum system having a sucking platform formed with a plurality of sucking holes through the sucking platform; and laying the substrate to be printed on the sucking platform, whereby upon operation of the vacuum system and actuation of the digital printing machine, the image of the pattern or logo will be digitally printed on the substrate as laid on the sucking platform for successfully digitally printing the patterns on the wetsuits.

6 Claims, 5 Drawing Sheets

METHOD FOR DIGITALLY PRINTING PATTERNS ON HIGH-ELASTICITY WETSUITS

BACKGROUND OF THE INVENTION

Digital printing on dark or black garments is not quite the same as printing on white or light ones. The process to digitally print the dark or black garments is similar to screen print in that a white foundation or white under base must be printed first, in order for allowing the design colors to be visible. Color may thus not look quite as bright when an under base is used because of base color bleeding or ink migration downwardly into the substrate, and the hand feel of the printed garment is not soft, thereby causing a poor hand feel when used.

Still, there is no disclosure of a digital printing as used for digital printing on a wetsuit.

The present inventor has found the drawbacks of the conventional printing arts, and invented the present method for efficiently digitally printing logos or patterns on wetsuits.

SUMMARY OF THE INVENTION

The object of the present invention is to provide a method comprising: coating a high-elasticity coating on a rubber foam or high-elasticity fabric of a wetsuit to form a substrate to be printed (or receiving substrate); providing a digital printing machine for uploading or inputting an image file of a pattern or logo to the digital printing machine; and providing a vacuum system having a sucking platform formed with a plurality of sucking holes through the sucking platform; and laying the substrate to be printed (or receiving substrate) on the sucking platform, whereby upon operation of the vacuum system and actuation of the digital printing machine, the image of the pattern or logo will be precisely digitally printed on the substrate as laid on the sucking platform in order for successfully digitally printing the patterns on the wetsuits, having increased elasticity, durable ink fixation and better hand feel.

DETAILED DESCRIPTION

The method of the present invention comprises the steps of:

1. Preforming a receiving substrate 1;
2. Preparation of a digital printing machine 2;
3. Setting up a vacuum system 3 for the digital printing machine; and
4. Actuation of the digital printing machine 2 for printing pattern image on the receiving substrate 1 as sucked by the vacuum system 3 for obtaining a printed wetsuit.

Figure 1:
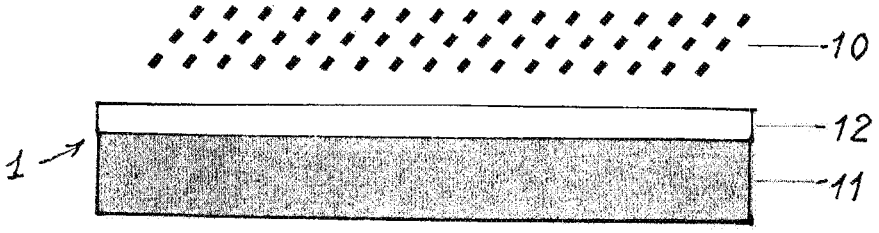
FIG. 1 is an illustration showing coating of a high-elasticity coating on a rubber foam for forming a receiving substrate in accordance with the present invention.
Figure 2:
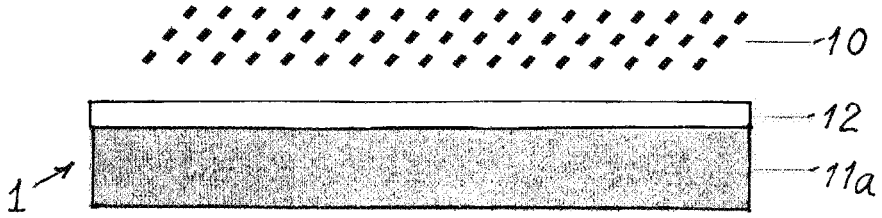
FIG. 2 is an illustration showing coating of a high-elasticity coating on a high-elasticity fabric for forming a receiving substrate in accordance with the present invention.
Figure 3:
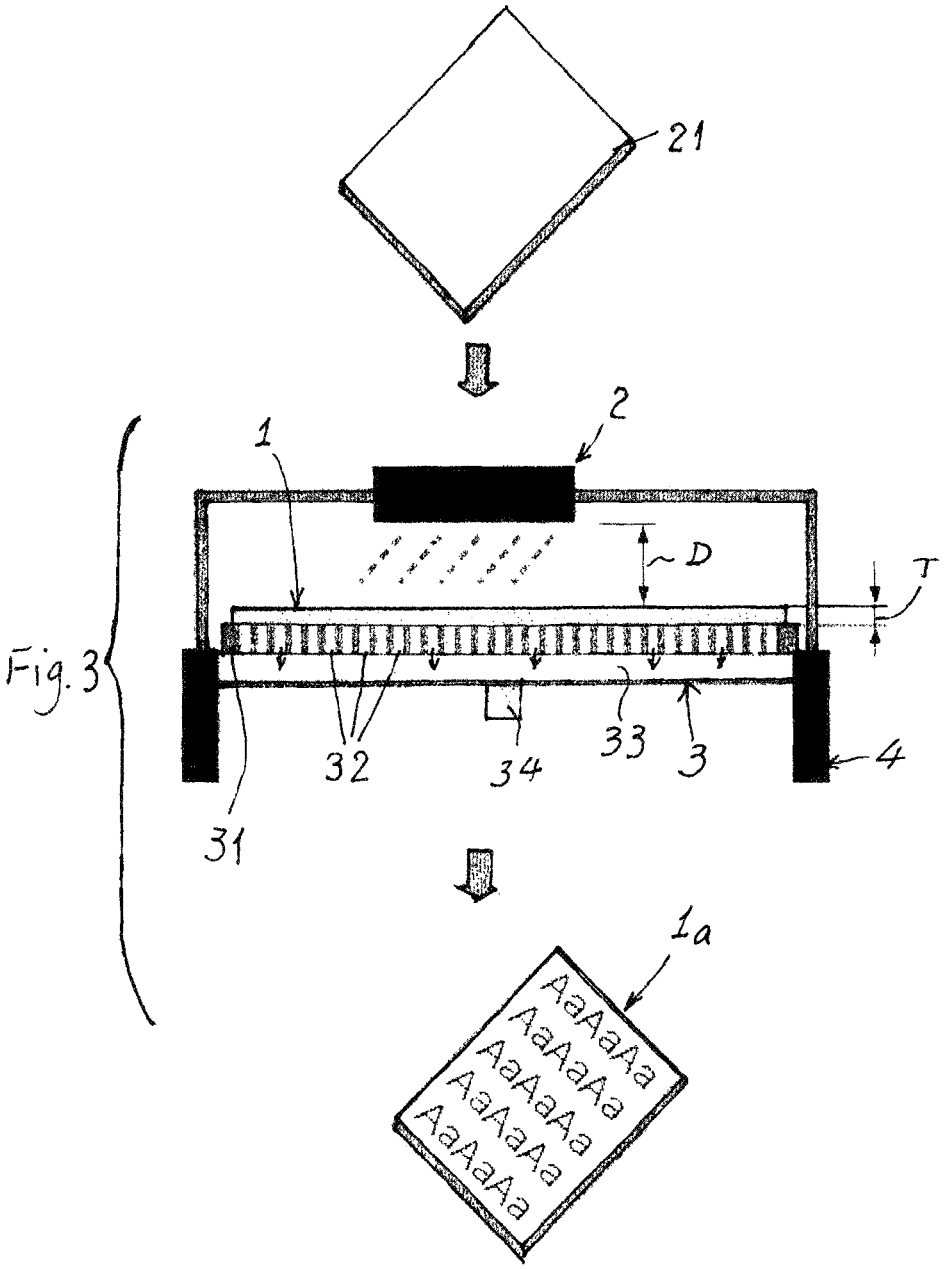
FIG. 3 is an illustration showing the printing process (for obtaining a full-scale pattern image of the printed product) in accordance with the present invention.

The steps of the method are respectively described in detail as follows:

1. Preforming a Receiving Substrate 1:
   - As shown in FIG. 1, a high-elasticity coating 12 is coated on a rubber foam 11 by digitally-controlled spray coating 10 to form a receiving substrate (or substrate to be printed) 1.
   - Such a high-elasticity coating 12 may include a Polyurethane-base coating adapted for miscible bonding of the printing ink on the Polyurethane base coating.
   - The high-elasticity rubber foam includes Nylon with Neoprene; Polyester with Neoprene, or Neoprene coated with high-elasticity Polyurethane coating.
   - As shown in FIG. 2, a high-elasticity coating 12 is coated on a high-elasticity fabric 1*a* by digitally-controlled spray coating 10 to form a receiving substrate 1.
   - The high-elasticity fabric 11*a* includes Nylon with Spandex or Polyester with Spandex.
   - Such a high-elasticity coating 12 on the substrate may increase the adhering of the writing ink on the substrate, thereby preventing from color bleeding, migration, and the deterioration of color printing on the substrate.
   - The receiving substrate 1 may refer to wetsuit, wetsuit sheet, wetsuit leather, or water sports garment, ready for digital printing as effected by the present invention.
2. Preparation of a Digital Printing Machine 2:
   - As shown in FIG. 3, a digital printing machine 2 of the present invention is provided for digital printing in the present invention. A pattern image file 21 is uploaded or input to the digital printing machine 2. The pattern defined herewith may refer to a pattern of art design, a logo, letters, words, figures, or an ornamental design.
   - An elastic ink is provided in the digital printing machine 2 in order to apply printing ink image onto the receiving substrate 1 through a printer head (not shown) of the digital printing machine. Such an ink may also be selected from environmentally friendly ink without solvent washing as required by a conventional ink.
3. Setting Up a Vacuum System 3:
   - As shown in FIG. 3, a vacuum system 3 is provided in the present invention, and which comprises: a sucking platform 31 having a plurality of suction holes 32 formed through the sucking platform 31, a suction hood 33 encasing a lower periphery of the sucking platform 31, and a vacuum pump 34 formed on a bottom portion of the suction hood 33 for producing vacuum in the vacuum system 3 and for sucking air downwardly as arrow direction shown in FIG. 3 in order to tightly flatten the receiving substrate 1 as laid on the sucking platform 31. A vacuum degree in the vacuum system may be optionally adjusted, depending upon the production requirements, or depending upon the thickness T (0.3~12 mm) of the receiving substrate 1.

The vacuum suction as provided in the vacuum system of the present invention plays very important roles as follows:

A. Since PU has a low surface tension. PU surface is difficulty digitally printed. The vacuum developed in the vacuum system 3 of the present invention may homogeneously suck the receiving substrate 1, especially for thin substrate, downwardly to flatten and tension the upper surface of the receiving substrate 1 to increase the surface tension of PU and to thereby increase the Printability of PU so as to well digitally print the pattern onto the PU surface of the receiving substrate 1 and to greatly increase the digital printing quality, especially beneficial for the printing of pattern on the wetsuit having PU surface.

B. The receiving substrate 1 as sucked on the perforated platform 31 by the vacuum system 3 may be stably fixed on the platform 31 for stably printing pattern on the substrate 1. Otherwise, the elastic PU coated wetsuit may be elastically corrugated or vibrated, being unable for performing a stable and fixed printing operation. Meanwhile, as the substrate being stably sucked, it is helpful for precisely adjusting the positioning of the substrate in a X-Y coordinate in order to obtain a reliable precise alignment of the image printing.

The digital printing machine 2 and the vacuum system 3 may be mounted on a frame 4 as shown in FIG. 3.

A printing distance D between a digital printer of the digital printing machine 2 and the sucking platform 31 may be optionally adjusted, depending upon the production requirements.

The number and distribution (holes 32 per unit area of platform 31) of the suction holes 32 formed through the platform 31 may be optimumly arranged when designing and installing the present invention.

4. Actuation of the digital printing machine 2:

As shown in FIG. 3, when the printing machine 2 and vacuum system 3 are properly implemented. The digital printing machine 2 is actuated to output pattern image to be printed on the receiving substrate 1 as laid on the platform 31 as sucked by the vacuum system 3.

The printed product or the printed wetsuit product 1*a* having full-scale pattern printed on the substrate is then obtained. Naturally, a localized (not full-scale) pattern may also be selected in this invention.

Figure 4:
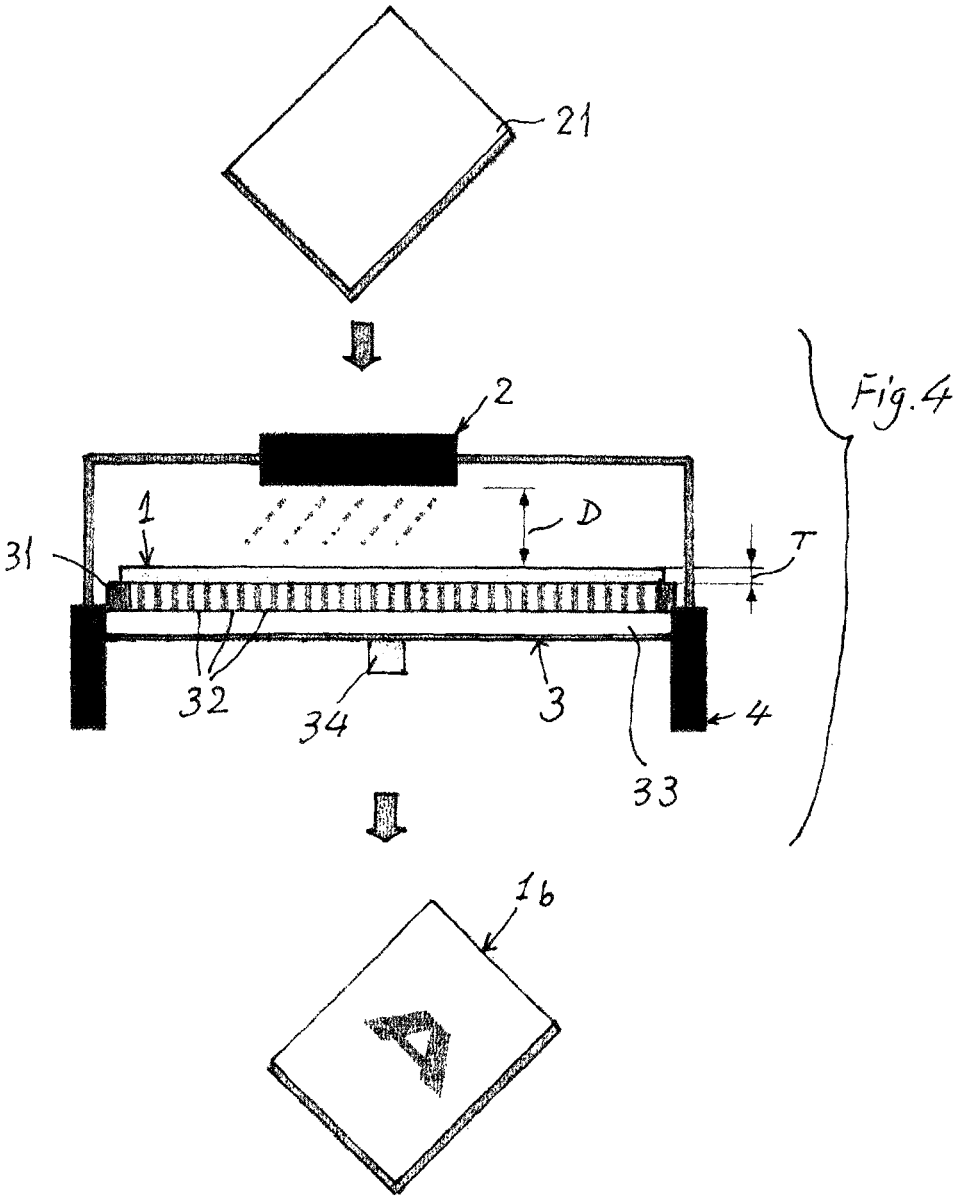
FIG. 4 shows a printing process for obtaining a limited-scale pattern (having small size) image in accordance with the present invention.

As shown in FIG. 4, the pattern as designed as limited-scale (with small pattern size) of the printed product 1*b* is presented.

Figure 5:
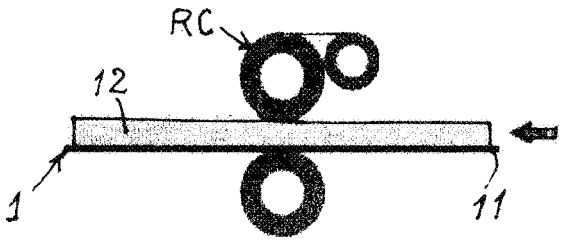
FIG. 5 shows a receiving substrate formed by roller printing in accordance with the present invention.
Figure 6:
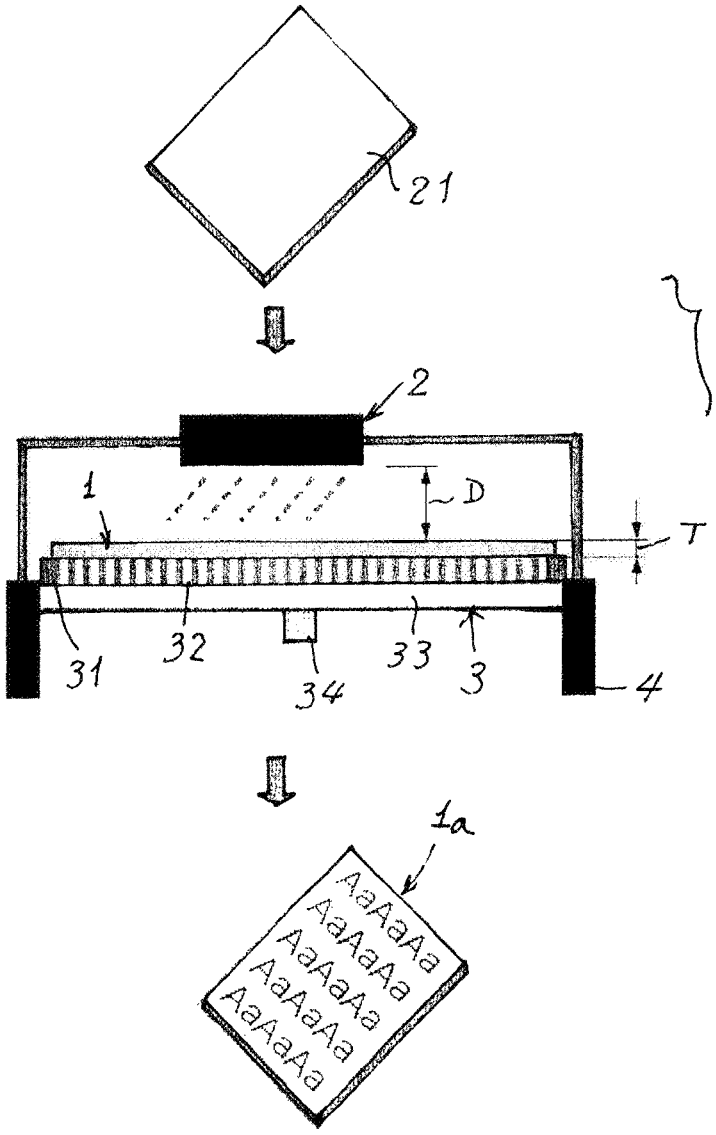
FIG. 6 shows a printing process for obtaining a full-scale pattern image on the receiving substrate which is formed by roller printing as shown in FIG. 5.

In FIGS. 5, 6, a full-scale pattern may be printed on a PU-coated fabric (the fabric made by a conventional roller coating, RC) for producing a wetsuit product 1*a*.

Figure 7:
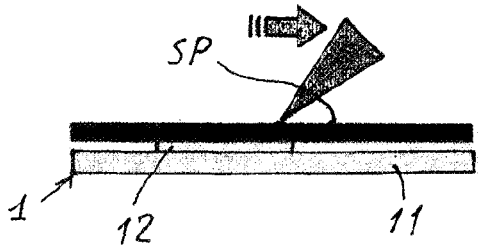
FIG. 7 shows a receiving substrate formed by screen printing in accordance with the present invention.
Figure 8:
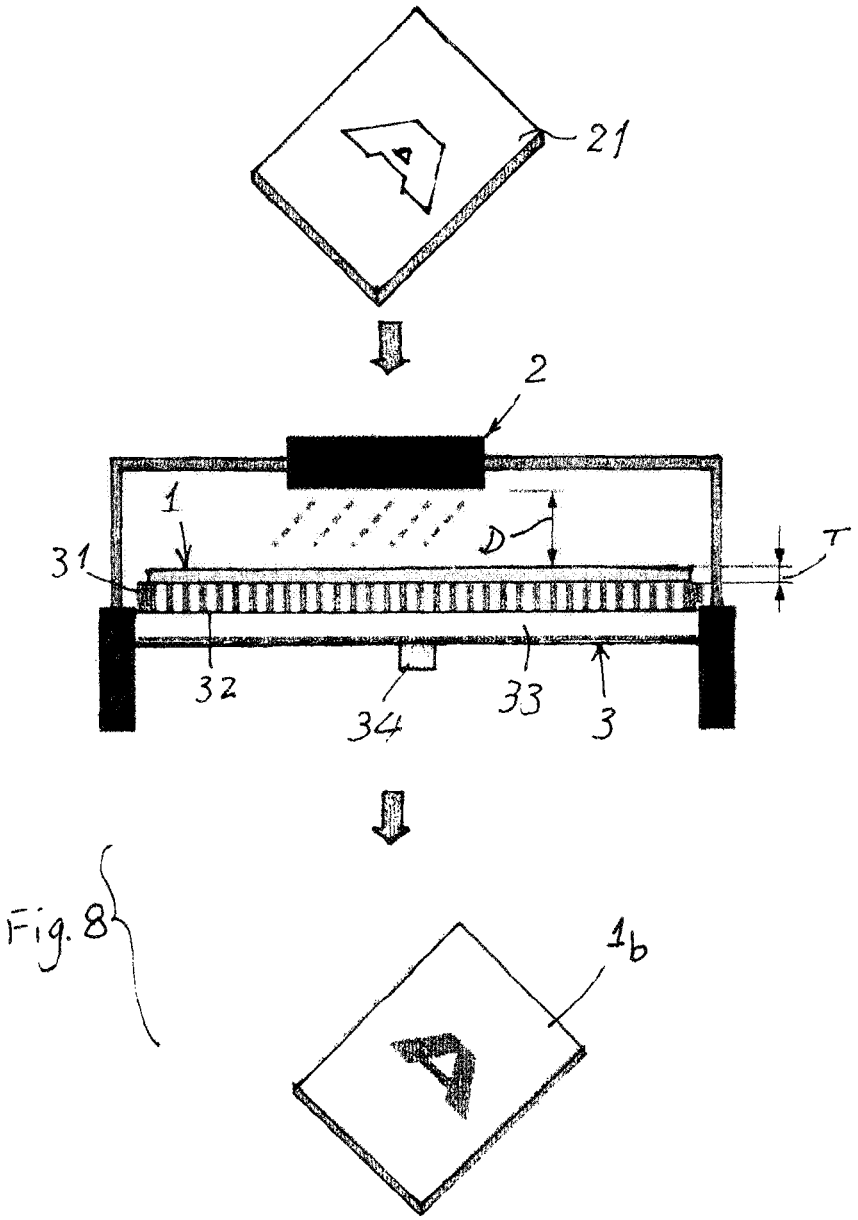
FIG. 8 shows a printing process for obtaining a limited-scale pattern (having small size) image on the receiving substrate which is formed by screen printing as shown in FIG. 7.

In FIGS. 7, 8, a logo (with small pattern size) may be printed on a PU-coated fabric (the fabric made by a conventional screen printing, SP) for producing a wetsuit product 1*b*.

After finishing the digital printing process, a specimen of PU-coated fabric sheet of the present invention is subjected to the following tests and the test results thereof are shown on the following table:

| Test Items | Test Conditions | Test Results |
|---|---|---|
| Mutual-adhering test | The specimen is half folded and dried at 60° C. for 24 hrs. | No mutual adhering between the two folded specimen portions. |
| UV exposure test | Exposed to UV radiation for 2 hours. | Not discolored. |
| Water-washing test | Washed by sea water for 24 hours. | Ink not removed. |
| Wear resistance test | Friction scrubbing on the printed surface. | Ink not removed. |
| Hand-feel test | Half folded to check any fine wrinkle. | No wrinkles found. |

From the above-mentioned test results, the present invention may provide a successful digital printing process, adapted to digitally print the patterns on the PU-coated wetsuits with a good product quality including increased elasticity, durable color-fixation, high resolution of image and better hand feel of the wetsuit.

The present invention may be further modified without departing from the spirit and scope of the present invention.

I claim:

1. A method for printing patterns on wetsuits, comprising the steps of:

a. preforming a receiving substrate (or substrate to be printed) by coating a high-elasticity coating on a rubber foam or high-elasticity fabric by digitally-controlled spray coating to form said receiving substrate;

b. preparation of a digital printing machine using an elastic ink, and having a pattern image file uploaded in said digital printing machine;

c. setting up a vacuum system for the digital printing machine; and d. actuation of the digital printing machine for printing pattern image on the receiving substrate as sucked by the vacuum system for increasing printability of the receiving substrate under tension as effected by the vacuum system for obtaining a printed wetsuit.

2. A method according to claim 1, wherein said high-elasticity coating includes a polyurethane-base coating adapted for miscible bonding of a printing ink on the polyurethane-base coating.

3. A method according to claim 1, wherein said rubber foam includes nylon with neoprene; polyester with neoprene, or neoprene coated with high-elasticity polyurethane coating.

4. A method according to claim 1, wherein said high-elasticity fabric includes nylon with Spandex or polyester with Spandex.

5. A method according to claim 1, wherein the step b for preparation of the digital printing machine includes uploading of said pattern image file having patterns including a pattern of art design, a logo, letters, words, figures, or an ornamental design.

6. A method according to claim 1, wherein said vacuum system in the step c for setting up the vacuum system comprises a sucking platform having a plurality of suction holes formed through the sucking platform, a suction hood encasing a lower periphery of the sucking platform, and a vacuum pump formed on a bottom portion of the suction hood for producing vacuum in the vacuum system and for sucking air downwardly in order to tightly flatten the receiving substrate as laid on the sucking platform.

* * * * *